US007431576B2

(12) United States Patent
Sun

(10) Patent No.: US 7,431,576 B2
(45) Date of Patent: Oct. 7, 2008

(54) DUCTILE CAST IRON SCROLL COMPRESSOR

(75) Inventor: Zili Sun, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 210 days.

(21) Appl. No.: 11/290,669

(22) Filed: Nov. 30, 2005

(65) Prior Publication Data

US 2007/0122302 A1 May 31, 2007

(51) Int. Cl.
*F01C 21/00* (2006.01)
*F01C 1/063* (2006.01)

(52) U.S. Cl. ..... 418/179; 418/55.2

(58) Field of Classification Search ..... 418/55.1, 418/178, 179, 152, 55.2
See application file for complete search history.

(56) References Cited

U.S. PATENT DOCUMENTS

| | | | | |
|---|---|---|---|---|
| 2,750,284 | A * | 6/1956 | Ihrig | 420/30 |
| 3,055,756 | A | 9/1962 | Kanter et al. | |
| 3,421,886 | A * | 1/1969 | Schelleng | 420/22 |
| 3,865,582 | A * | 2/1975 | Church et al. | 420/83 |
| 4,363,661 | A | 12/1982 | Kovacs | |
| 4,944,663 | A | 7/1990 | Iizuka et al. | |
| 5,087,181 | A * | 2/1992 | Kamitsuma et al. | 418/178 |
| 5,277,562 | A * | 1/1994 | Fukuhara et al. | 418/179 |
| 5,439,360 | A | 8/1995 | Barito | |
| 5,478,417 | A * | 12/1995 | Heck et al. | 148/328 |
| 5,548,973 | A * | 8/1996 | Komine et al. | 62/469 |
| 5,580,230 | A * | 12/1996 | Keifer et al. | 418/55.5 |
| 5,580,401 | A | 12/1996 | Williamson | |
| 5,755,271 | A | 5/1998 | Williamson | |
| 5,806,336 | A | 9/1998 | Sunaga et al. | |
| 6,006,542 | A | 12/1999 | Tojo et al. | |
| 6,053,714 | A | 4/2000 | Fenocchi et al. | |
| 6,055,827 | A | 5/2000 | Tojo et al. | |
| 6,139,296 | A | 10/2000 | Okajima et al. | |
| 6,176,094 | B1 | 1/2001 | Ohta et al. | |
| 6,189,322 | B1 | 2/2001 | Ishihara et al. | |
| 6,286,334 | B1 | 9/2001 | Tojo et al. | |
| 6,302,665 | B1 | 10/2001 | Esumi et al. | |
| RE37,520 | E | 1/2002 | Williamson | |
| 6,598,421 | B1 | 7/2003 | Suzuki et al. | |
| 6,667,285 | B1 | 12/2003 | Kawahara et al. | |
| 6,705,848 | B2 * | 3/2004 | Scancarello | 418/55.2 |

(Continued)

FOREIGN PATENT DOCUMENTS

EP 1331395 A2 7/2003

(Continued)

OTHER PUBLICATIONS

Metallurgy and Properties of Gray Irons, ASM Specialty Handbook, ASM International , 1996.

(Continued)

*Primary Examiner*—Thomas Denion
*Assistant Examiner*—Mary A Davis
(74) *Attorney, Agent, or Firm*—Carlson, Gaskey & Olds, PC

(57) ABSTRACT

A scroll compressor includes a scroll member having a base and a generally spiral wrap that extends from the base to define a portion of a compression chamber. The scroll member is made of a cast iron material comprising a microstructure having graphite nodules.

13 Claims, 3 Drawing Sheets

U.S. PATENT DOCUMENTS

| | | | | |
|---|---|---|---|---|
| 6,860,315 | B2 | 3/2005 | Williamson | |
| 6,874,325 | B2 | 4/2005 | Suzuki et al. | |
| 6,948,922 | B2 * | 9/2005 | Esumi et al. | 418/179 |
| 7,265,080 | B2 | 9/2007 | Iso et al. | |
| 2004/0140018 | A1 * | 7/2004 | Sato et al. | 148/417 |
| 2005/0210891 | A1 | 9/2005 | Matsumoto et al. | |
| 2006/0191604 | A1 * | 8/2006 | Itoh et al. | 148/321 |

FOREIGN PATENT DOCUMENTS

| | | | |
|---|---|---|---|
| EP | 1544469 | | 6/2005 |
| EP | 1652949 | | 5/2006 |
| JP | 59079089 | | 5/1984 |
| JP | 59079089 | A * | 5/1984 |
| JP | 9329091 | | 12/1997 |
| WO | 2006072663 | | 7/2006 |

OTHER PUBLICATIONS

Heat Treating of Gray irons, ASM Specialty Handbook, ASM International, 1996.
Standard Specification for Gray iron Castings, ASTM International.
Standard Test Method for Evaluating the Microstructure of Graphite in Iron Castings, ASTM.
Ferrous Castings, Automotive Gray Iron Castings, SAE J431.
Standard Specification for Ductile Iron Castings, ASTM International.
Heat Treating of Ductile Irons, ASM Specialty Handbook, ASM International, 1996.
Metallurgy and Properties of Ductile Irons, ASM Specialty Handbook, ASM International, 1996.
Automotive Ductile (Nodular) Iron Castings, SAE J434 Feb. 2004.
European Search Report dated Sep. 14, 2007.
European Search Report dated Sep. 26, 2007.

* cited by examiner

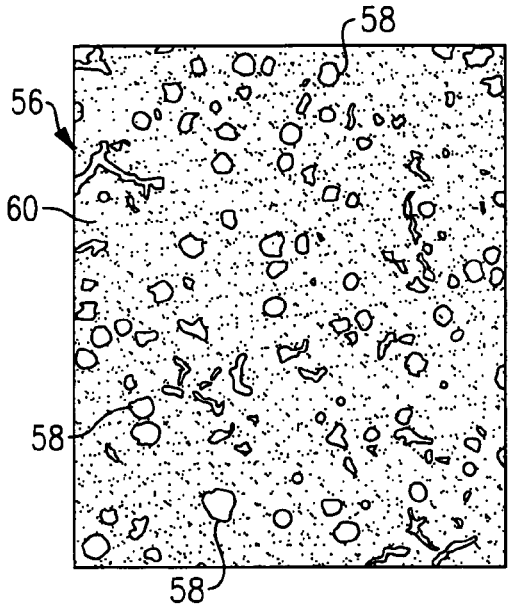
FIG.4
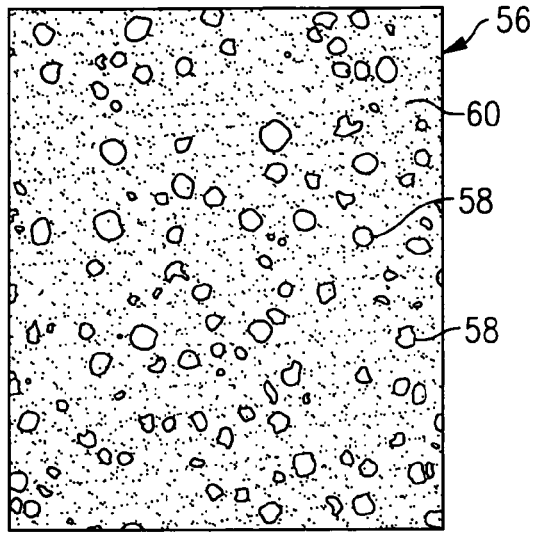
FIG.5
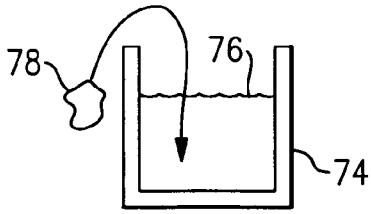
FIG.6
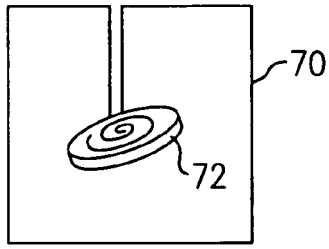

DUCTILE CAST IRON SCROLL COMPRESSOR

BACKGROUND OF THE INVENTION

This application relates to scroll compressors and, more particularly, to a scroll compressor member with improved strength and durability.

Scroll compressors are becoming widely utilized in refrigerant compression systems. As known, a pair of scroll members each has a base with a generally spiral wrap extending from the base. Typically, one scroll is non-orbiting and the other scroll orbits relative to the non-orbiting scroll. The orbiting scroll contacts the non-orbiting scroll to seal and define compression chambers. One of the two scroll members is caused to orbit relative to the other, with the size of the compression chambers decreasing toward a discharge port as refrigerant is being compressed.

One example refrigerant compression system includes an air conditioning or other environmental conditioning system. As is known, a compressor compresses a refrigerant and sends the refrigerant to a downstream heat exchanger, and typically a condenser. From the condenser, the refrigerant travels through a main expansion device, and then to an indoor heat exchanger, typically an evaporator. From the evaporator, the refrigerant returns to the compressor. Generally, the performance and efficiency of the system relies, at least in part, on the capacity and efficiency of the scroll compressor. Thus, there has been a trend toward higher capacity and higher efficiency scroll compressors.

One concern in designing higher capacity scroll compressors is the strength and durability of the scroll members. Higher capacity compressors operate under increasingly severe conditions, such as higher forces and increased wear between the scroll members. Use of current materials for the scroll members has proven successful in many compressors but may not be suited for more severe operating conditions. For example, under extreme operating conditions, the scroll members may break or wear excessively. Thus, even though higher capacity designs may be available, stronger and more durable scroll member materials are needed to realize the capacity benefits of such designs.

Accordingly, it would be desirable to provide scroll members that are able to withstand more severe conditions in order to enhance compressor capacity.

SUMMARY OF THE INVENTION

One embodiment of a scroll compressor includes a scroll member having a base and a generally spiral wrap that extends from the base to define a portion of a compression chamber. The scroll member is made of a cast iron material comprising a microstructure having graphite nodules.

One embodiment scroll compressor includes a scroll member having a base and a generally spiral wrap that extends from the base to define a portion of a compression chamber. The scroll member is made of a material having a graphite nodule-forming agent.

One embodiment method of manufacturing the scroll compressor includes the steps of melting a cast iron material to produce a molten material, adding a nodule-forming agent to the molten material, and transferring the molten material into a mold having a shape of a scroll compressor member.

In the disclosed examples, the scroll member is relatively strong and durable. This allows the scroll compressor to withstand more severe operating conditions associated with high capacity compressor designs.

The above examples are not intended to be limiting. Additional examples are described below.

These and other features of the present invention can be best understood from the following specification and drawings, the following of which is a brief description.

BRIEF DESCRIPTION OF THE DRAWINGS

FIG. 4 is a schematic illustration of a microstructure having graphite nodules of a cast iron material used to make the scroll members.

FIG. 5 schematically illustrates another example microstructure having graphite nodules.

FIG. 6 schematically illustrates an example casting process.

DETAILED DESCRIPTION OF THE PREFERRED EMBODIMENT

Figure 1:
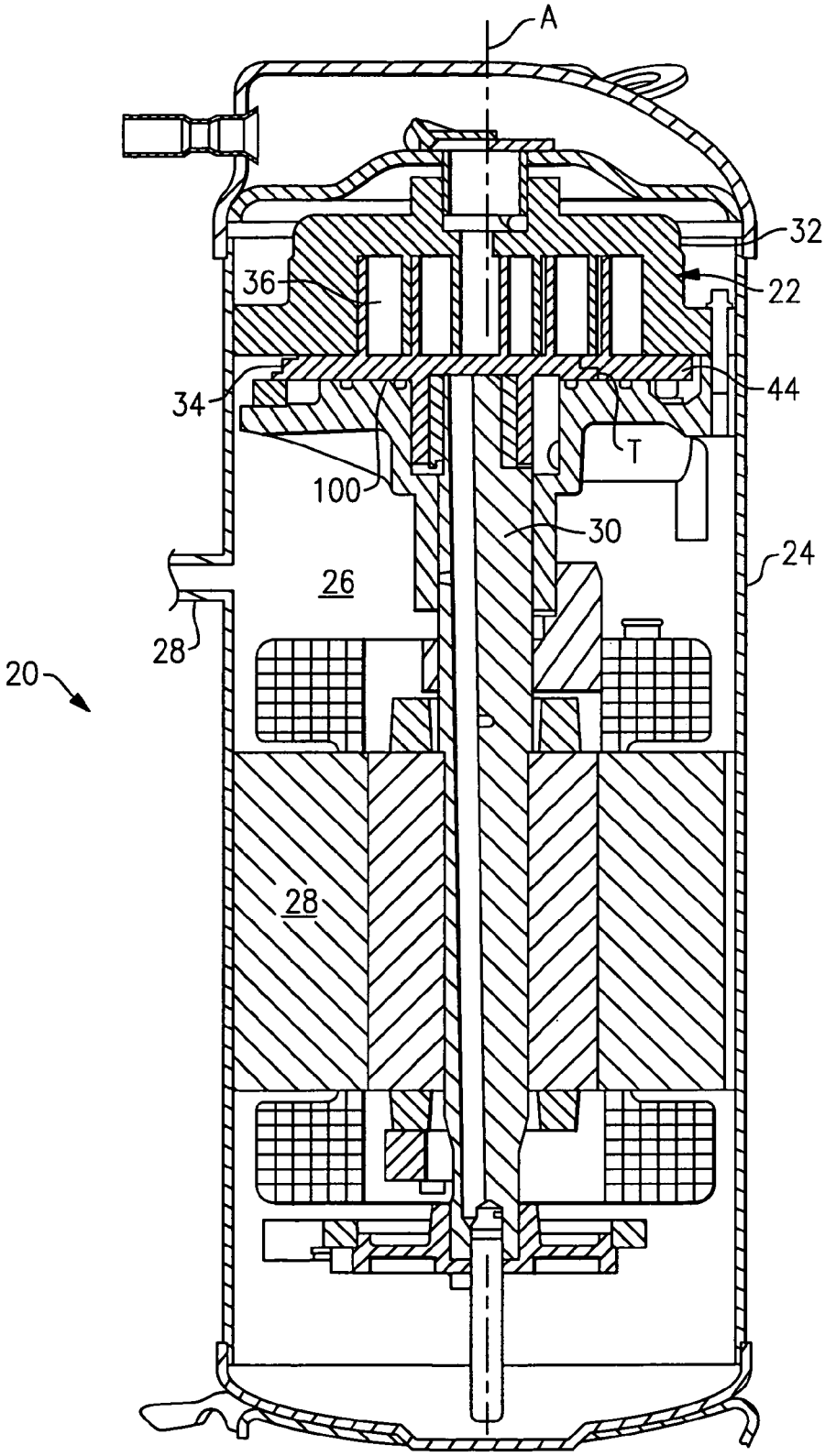
FIG. 1 is a cross-sectional view of an example scroll compressor.

FIG. 1 shows a scroll compressor 20. As shown, a compressor pump set 22 is mounted within a sealed shell 24. A suction chamber 26 receives a suction refrigerant from a tube 28. As can be appreciated, this refrigerant can circulate within the chamber 26, and flows over an electric motor 28. The electric motor 28 drives a shaft 30 that defines an operative axis A for the compressor 20. The compressor pump set 22 includes a non-orbiting scroll 32 and an orbiting scroll 34. As is known, the shaft 30 drives the orbiting scroll 34 to orbit relative to the non-orbiting scroll 32.

Figure 3:
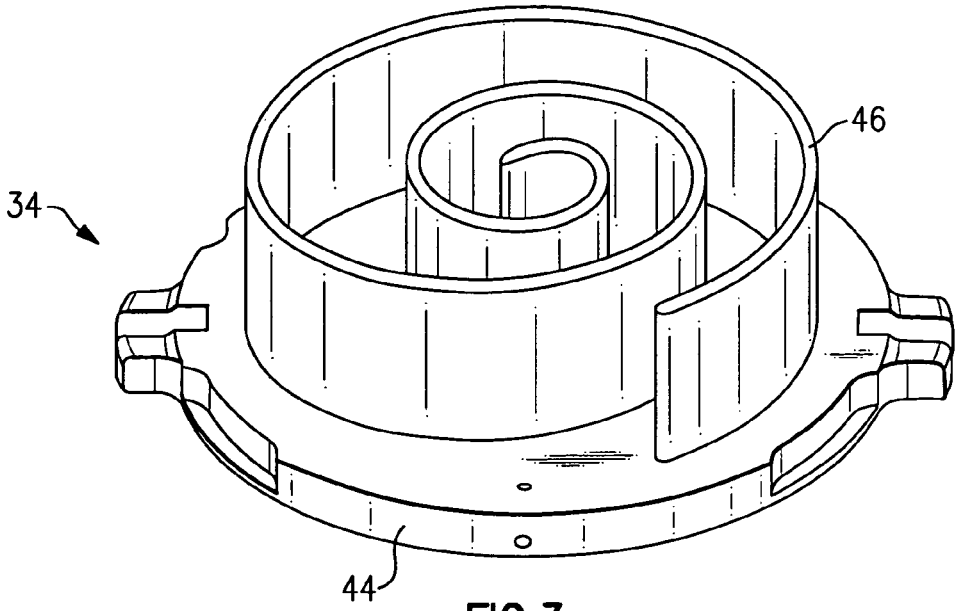
FIG. 3 is a perspective view of an orbiting scroll member for use in the scroll compressor of FIG. 1.
Figure 2:
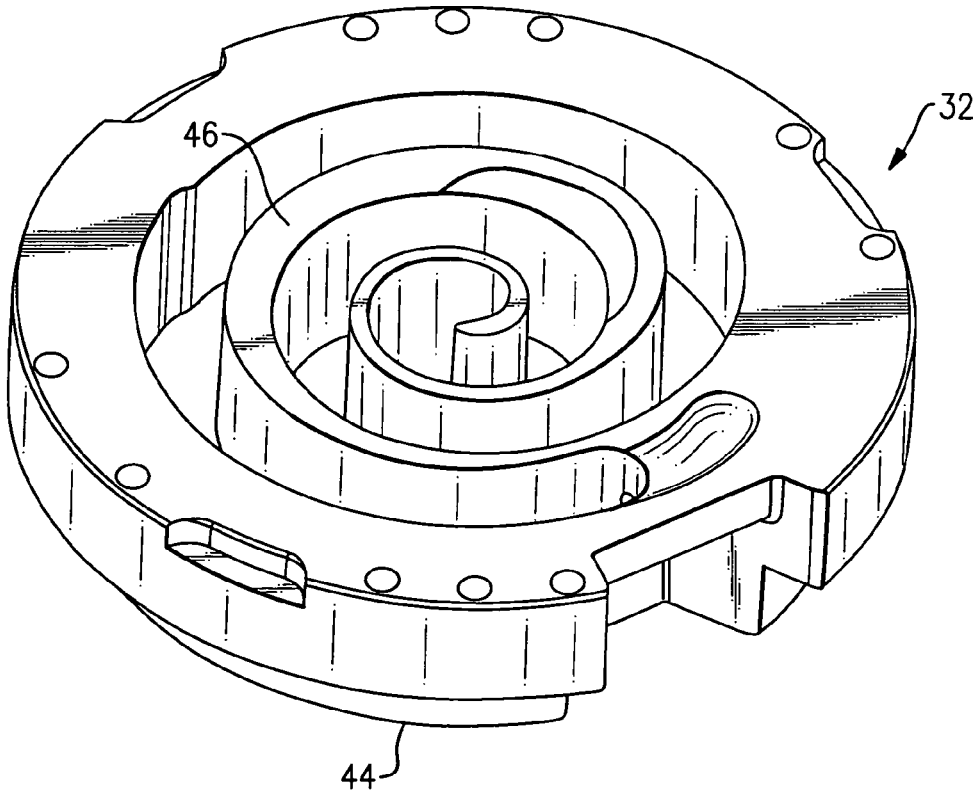
FIG. 2 is a perspective view of a non-orbiting scroll member for use in the scroll compressor of FIG. 1.

FIG. 2 shows a perspective view of the non-orbiting scroll 32 and FIG. 3 shows a perspective view of the orbiting scroll 34. Each of the non-orbiting scroll 32 and orbiting scroll 34 includes a base portion 44 and a generally spiral wrap 46 that extends from the base portion 44. When assembled, the spiral wraps 46 interfit to define compression chamber 36 (FIG. 1) between the non-orbiting scroll 32 and orbiting scroll 34.

In the illustrated example, there is radial and axial compliance (relative to axis A) between the non-orbiting scroll 32 orbiting scroll 34. Compliance allows the scrolls 32 and 34 to separate under certain conditions, such as to allow a particle to pass through the scroll compressor 20. Axial compliance maintains the wrap 46 of the orbiting scroll 34 in contact with the base portion 44 of the non-orbiting scroll 32 to provide a seal under normal operating conditions. A tap T taps a compressed refrigerant to a chamber 100 behind the base 44 of the orbiting scroll 34. The resultant force biases the two scroll members into contact. In other scroll compressors, the chamber can be behind the base of the non-orbiting scroll. Radial compliance maintains the wraps 46 of the non-orbiting scroll 32 and orbiting scroll 34 in contact under normal operating conditions.

Referring to FIG. 4, one or both of the non-orbiting scroll 32 and orbiting scroll 34 are made of a cast iron material having a microstructure 56 that includes graphite nodules 58. In the illustrated examples, the graphite nodules are within a matrix 60, such as a pearlite matrix. The microstructure 56 in this example is shown at a magnification of approximately 36×. The cast iron material is polished and etched in a known manner to reveal the microstructure 56.

The microstructure 56 includes an associated nodularity, which is a ratio of graphite nodules 58 to the total graphite including other forms of graphite, within the matrix 60. In one example, the nodularity is above about 80% and below 100%. In the example shown in FIG. 4, the nodularity is about 80%. In another example shown in FIG. 5, the nodularity is about 99%.

The graphite nodules 58 provide the non-orbiting scroll 32 and the orbiting scroll 34 with strength and durability. Other cast iron microstructures, such as those that include primarily graphite flakes, are weakened due to a notch effect at sharp edges of the graphite flakes. The graphite nodules 58, however, are spheroidal in shape and therefore do not have the sharp edges that weaken the material. Generally, higher nodularity results in higher strength and higher toughness. In one example, the cast iron material with graphite nodules 58 has a tensile strength of at least 60 kpsi. For example, the tensile strength can be tested using ASTM A395 or other known standard. The high strength and durability makes the non-orbiting scroll 32 and the orbiting scroll 34 relatively strong and wear resistant, which allows the scroll compressor 20 to be designed for relatively severe operating conditions and high capacities. In one example, use of cast iron material having graphite nodules 58 allows the wraps 46 to be increased in length (i.e., length extended from base 44) to increase the size of the compression chambers 34 and, in turn, increase the capacity of the scroll compressor 20.

In one example, the relatively severe operating conditions are caused, at least in part, from the axial and radial compliance between the non-orbiting scroll 32 and the orbiting scroll 34. The axial and radial compliance causes contact between the non-orbiting scroll 32 and the orbiting scroll 34 as described above. During operation of the scroll compressor 20, the contact causes wear and stress between the non-orbiting scroll 32 and the orbiting scroll 34. The strong and durable cast iron material with graphite nodules 58 is suited to withstand such operating conditions.

The cast iron material of the non-orbiting scroll 32 and/or the orbiting scroll 34 includes a graphite nodule-forming agent that promotes formation of the graphite nodules 58 during casting. In one example, the cast iron material composition includes 3.20 wt %-4.10 wt % carbon, 1.80 wt %-3.00 wt % silicon, 0.10 wt %-1.00 wt % manganese, up to 0.050 wt % phosphorous, and an amount of the graphite nodule-forming agent. In a further example, the cast iron material composition includes about 3.60 wt %-3.80 wt % carbon.

In one example, the graphite nodule-forming agent includes magnesium. The magnesium is present in the cast iron material of the non-orbiting scroll 32 and/or the orbiting scroll 34 in an amount between about 0.02 wt % and about 0.08 wt %. In another example, the magnesium is present in an amount between about 0.03 wt % and about 0.06 wt %.

In another example, the graphite nodule-forming agent is an alloy, such as an alloy of magnesium. In one example, the alloy includes magnesium and nickel. The magnesium comprises between about 4 wt % and about 18 wt % of the alloy, the balance being nickel and possibly trace amounts of other materials.

In another example, the graphite nodule-forming agent includes both magnesium and cerium. In one example, the magnesium is present in the cast iron material of the non-orbiting scroll 32 and/or the orbiting scroll 34 in an amount as described above and the cerium is present in an amount between about 0.0005 wt % and about 0.01 wt %. The magnesium and cerium are added to the molten cast iron as described above. Alternatively, or in addition to magnesium and cerium, a rare earth metal is used in an amount up to 0.300 wt % to form the graphite nodules 58. Example rare earth metals include praseodymium, neodymium, promethium, samarium, europium, gadolinium, terbium, dysprosium, holmium, erbium, thulium, ytterbium, lutetium, yttrium, scandium, thorium, and zirconium, although use of these may be limited by availability and/or cost.

The graphite nodule-forming agent is added to molten cast iron during the casting process of the non-orbiting scroll 32 and/or the orbiting scroll 34. For example, the amount added is suitable to result in the composition ranges described above.

The amount of graphite nodule-forming agent added to the molten cast iron is generally greater than the above-described composition ranges. In one example, about 0.3 wt % graphite nodule-forming agent is added. This provides the benefit of adding enough graphite nodule-forming agent to promote graphite nodule 58 formation while allowing for depletion of the graphite nodule-forming agent, such as through volatilization. Given this description, one of ordinary skill in the art will recognize suitable graphite nodule-forming agent amounts to add to the molten cast iron to meet their particular needs.

The amount of graphite nodule-forming agent controls the nodularity of the microstructure 56. For example, a relatively small amount leads to lower nodularity and a relatively larger amount leads to a higher nodularity. Thus, the graphite nodule-forming agent composition ranges described herein can be used to tailor the properties, such as strength, wear, and galling, of the non-orbiting scroll 32 and/or the orbiting scroll 34 to the particular operational demands of the scroll compressor 20.

FIG. 6 schematically illustrates an example casting process. A casting mold 70 defines a cavity 72 for forming the shape of the non-orbiting scroll 32 or orbiting scroll 34. A container 74, such as a ladle, holds molten cast iron material 76, which will be poured into the casting mold 70 and solidify. Before pouring, a graphite nodule-forming agent 78 is added to the molten cast iron material 76. Optionally, a predetermined period of time elapses between adding the graphite nodule-forming agent and pouring the molten cast iron material 76 into the casting mold 70 to allow dispersion of the graphite nodule-forming agent 78 in the molten cast iron material.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a scroll member having a base and a generally spiral wrap that extends from said base to define at least a portion of a compression chamber, wherein said scroll member comprises a material having a 3.2 wt %-4.1 wt % carbon, 1.8 wt %-3 wt % silicon, 0.1 wt %-1 wt % manganese, about 0.02 wt %-0.08 wt % magnesium, about 0.0005 wt %-0.01 wt % cerium, about 0.3 wt % zirconium, and a balance of iron.

2. The scroll compressor as recited in claim 1, wherein the material includes a microstructure having graphite nodules.

3. The scroll compressor as recited in claim 2, wherein said graphite nodules are in a ferrite-pearlite matrix.

4. The scroll compressor as recited in claim 2, wherein said microstructure has a nodularity above about 80% and below 100%.

5. The scroll compressor as recited in claim 2, wherein said nodules are spheroidal.

6. The scroll compressor as recited in claim 1, including a second scroll member having a base and a generally spiral wrap extending from its base, said second scroll member being driven to orbit relative to said scroll member, said wraps of said scroll members inter-fitting to define said compression chamber, wherein said scroll members are axially and radially compliant.

7. The scroll compressor as recited in claim 1, wherein said magnesium comprises an alloy of nickel and said magnesium.

8. The scroll compressor as recited in claim 7, wherein said magnesium comprises between about 4 wt % and about 18 wt % of said alloy.

9. The scroll compressor as recited in claim 1, wherein said magnesium comprises between about 0.03 wt % and about 0.06 wt % of said material.

10. The scroll compressor as recited in claim 1, wherein said material has a tensile strength greater than 60 kpsi.

11. A method of manufacturing a scroll compressor, comprising:

(a) melting a cast iron material to produce a molten material;

(b) adding a nodule-forming agent to the molten material to form an alloy including 3.2 wt %-4.1 wt % carbon, 1.8 wt %-3 wt % silicon, 0.1 wt %-1 wt % manganese, about 0.02 wt %- 0.08 wt % magnesium, about 0.0005 wt %-0.01 wt % cerium, about 0.3 wt % zirconium, and a balance of iron; and (c) transferring the molten material into a mold having a shape to form a scroll compressor member.

12. The method as recited in claim 11, including cooling the molten material to form the scroll compressor member, including a base and a generally spiral wrap that extends from the base to define at least a portion of a compression chamber.

13. The method as recited in claim 11, including adding an alloy of nickel and the magnesium.

* * * * *

UNITED STATES PATENT AND TRADEMARK OFFICE

CERTIFICATE OF CORRECTION

PATENT NO. : 7,431,576 B2
APPLICATION NO. : 11/290669
DATED : October 7, 2008
INVENTOR(S) : Sun It is certified that error appears in the above-identified patent and that said Letters Patent is hereby corrected as shown below:

Claim 6, Column 5, line 1: "1" should read as --2--

Signed and Sealed this

Second Day of December, 2008

JON W. DUDAS
*Director of the United States Patent and Trademark Office*